US011156428B1

(12) United States Patent
Nishihira

(10) Patent No.: US 11,156,428 B1
(45) Date of Patent: Oct. 26, 2021

(54) BOW

(71) Applicant: Ternarc Inc., Okayama (JP)

(72) Inventor: Morikazu Nishihira, Kurashiki (JP)

(73) Assignee: Ternarc Inc., Okayama (JP)

( * ) Notice: Subject to any disclaimer, the term of this patent is extended or adjusted under 35 U.S.C. 154(b) by 0 days.

(21) Appl. No.: 17/204,938

(22) Filed: Mar. 18, 2021

(30) Foreign Application Priority Data

Nov. 9, 2020 (JP) ..... JP2020-186263

(51) Int. Cl.
*F41B 5/10* (2006.01)
*F41B 5/14* (2006.01)
*F41B 5/00* (2006.01)

(52) U.S. Cl.
CPC ..... *F41B 5/105* (2013.01); *F41B 5/0094* (2013.01); *F41B 5/1449* (2013.01)

(58) Field of Classification Search
CPC ..... F41B 5/0094; F41B 5/10
See application file for complete search history.

(56) References Cited

U.S. PATENT DOCUMENTS 4,207,859 A * 6/1980 Scholten ..... F41B 5/0094 124/25.6
5,150,699 A * 9/1992 Boissevain ..... F41B 5/0094 124/23.1
6,067,974 A * 5/2000 Islas ..... F41B 5/0094 124/25.6
6,688,295 B1 2/2004 Miller
7,201,161 B1 * 4/2007 York ..... F41B 5/0094 124/16
7,441,555 B1 10/2008 Larson
8,136,514 B2 * 3/2012 Howard ..... F41B 5/10 124/23.1
8,522,762 B2 * 9/2013 Trpkovski ..... F41B 5/1453 124/25.6
10,145,642 B1 * 12/2018 Darlington ..... F41B 5/123
10,184,749 B2 * 1/2019 Trpkovski ..... F41B 5/105
10,746,496 B2 8/2020 Nishihira

FOREIGN PATENT DOCUMENTS

JP S55-33507 A 3/1980

* cited by examiner

*Primary Examiner* — John A Ricci
(74) *Attorney, Agent, or Firm* — Yokoi & Co., U.S.A.; Toshiyuki Yokoi

(57) ABSTRACT

A bow capable of replacing the cable more easily is provided. A bow, includes: a bow body; a plurality of string cams around which each of both ends of a string for nocking an arrow is wound, the string cams being rotated when the string is drawn; a plurality of cable cams around which each of both ends of an elastically deformable cables is wound, each of the cable cams being rotated interlockingly with each of the string cams to elastically deform the cables; and a plurality of holders, each of the holders having a base portion pivotably held on each of both ends of the bow body and an end portion for rotatably holding each of the cable cams.

5 Claims, 5 Drawing Sheets

BOW

CROSS-REFERENCES TO RELATED APPLICATIONS

This patent specification is based on Japanese patent application, No. 2020-186263 filed on Nov. 9, 2020 in the Japan Patent Office, the entire contents of which are incorporated by reference herein.

BACKGROUND OF THE INVENTION

1. Field of the Invention

The present invention relates to a bow.

2. Description of Related Art

A bow for shooting an arrow by an elastic energy of a cable by drawing a string to elastically deform the cable without elastically deforming a limb has been developed.

For example, Patent Document 1 discloses a bow having string cams around which a string is wound and cable cams around which an elastically deformable cable is wound and the cable cams are rotated interlockingly with the string cams to elastically deform the cable.

[Patent Document 1] Japanese Patent No. 6666536

BRIEF SUMMARY OF THE INVENTION

In the bow disclosed in Patent Document 1, the cable is tensed between two cable cams. Consequently, the cable is elastically deformed to a certain extent and tensile force is applied to the cable even in a state that the cable cams are not rotated. Accordingly, when replacing the cable, a work for pulling the cable by the force larger than the above described tensile force is required. As a result, the replacement of the cable is not easy.

The present invention provides a bow capable of replacing the cable more easily.

A bow concerning the present invention includes: a bow body; a plurality of string cams around which each of both ends of a string for nocking an arrow is wound, the string cams being rotated when the string is drawn; a plurality of cable cams around which each of both ends of an elastically deformable cable is wound, each of the cable cams being rotated interlockingly with each of the string cams to elastically deform the cable; and a plurality of holders, each of the holders having a base portion pivotably held on each of both ends of the bow body and an end portion for rotatably holding each of the cable cams, wherein each of the holders is configured to pivot with respect to each of the both ends of the bow body to switch a posture of the holders between a first state for tensioning the cable where the end portion is arranged on an extension line extending from each of the both ends of the bow body and a second state for loosening the cable where the end portion is arranged nearer to a center of the bow body compared to the extension line.

The bow can further include a shaft member arranged on each of the both ends of the bow body, the shaft member extending in a direction perpendicular to the direction connecting the both ends of the bow body and perpendicular to the direction of shooting the arrow, wherein the base portion provided on each of the holders is pivotable around the shaft member.

The bow can further include a locking mechanism for stopping a pivot of each of the holders and fixing each of the holders to each of the both ends of the bow body when each of the holders is pivoted with respect to each of the both ends of the bow body to switch the posture of the holders to the first state for tensioning the cable.

The locking mechanism can include: a contact member provided on either one of each of the holders and each of the both ends of the bow body to stop the pivot of each of the holders by contacting with a stopper formed on the other of each of the holders and the both ends of the bow body when each of the holders is pivoted with respect to each of the both ends of the bow body to switch the posture of the holders to the first state for tensioning the cable; and a fixing member for fixing each of the holders to each of the both ends of the bow body in a state that the contact member stops the pivot of each of the holders.

Each of the holders can have a protruding member which is arranged at a part most separated from a pivot center of each of the holders in the end portion, the protruding member being protruded rearward compared to the string tensed between the string cams when the posture of the holders is in the first state for tensioning the cable.

By using the configuration of the present invention, each of the holders can be pivoted with respect to each of the both ends of the bow body to switch a posture of the holders between a first state for tensioning the cable where the end portion is arranged on an extension line extending from each of the both ends of the bow body and a second state for loosening the cable where the end portion is arranged nearer to a center of the bow body compared to the extension line. Accordingly, each of the holders is pivoted with respect to each of the both ends of the bow body to switch the state of the cable to the loosened state. Thus, the cable can be replaced. As a result, the replacement of the cable is easy.

DETAILED DESCRIPTION OF THE INVENTION

Figure 1:
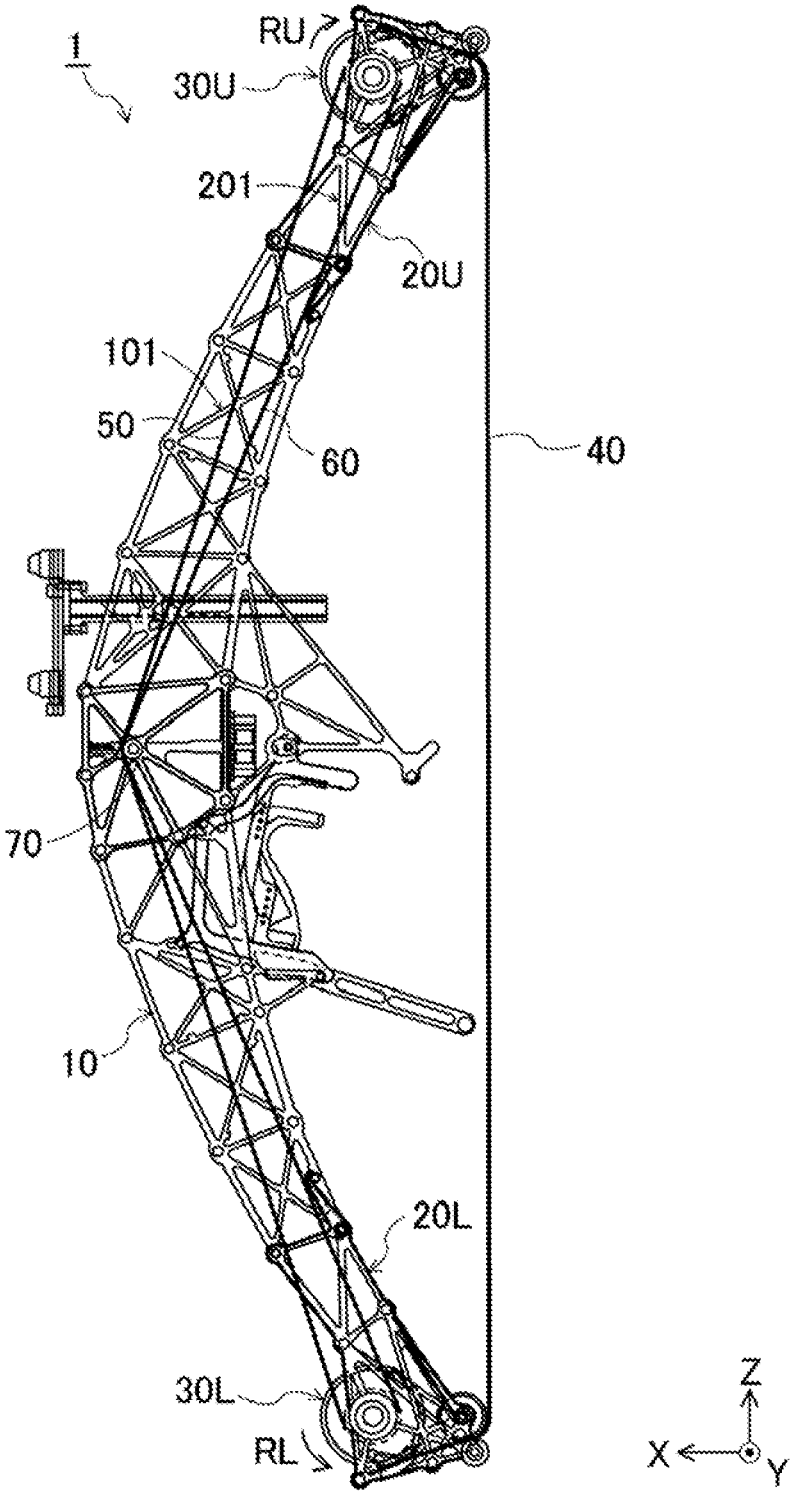
FIG. 1 is a side view of a bow concerning an embodiment of the present invention.

Hereafter, the bow concerning the embodiments of the present invention will be explained in detail with reference to the drawings. Note that the same reference sign is added to the same or similar configuration in the drawings. In the orthogonal coordinate system XYZ shown in the drawings, when a bow body having an arc-shape is directed in a vertical direction and an arrow is shot frontward, the vertical direction is the z direction, the front-back direction is X direction, and the direction orthogonal to the Z direction and the X direction is the Y direction. Hereafter, the above described coordinate system is arbitrarily used in the explanation.

A bow concerning the embodiment of the present invention is the bow that does not have limbs and shoots an arrow by elastically deforming cables instead of the limbs. In the above described bow, the cams to which the cables are wound are not attached to the bow body itself and attached to holders provided on both ends of the bow body for facilitating the replacement of the cables to which the tensile force is applied. The holder can be folded (foldable) with respect to the bow body. First, the configuration of the whole bow will be explained with reference to FIG. 1 and FIGS. 2A to 2C.

Figure 2A:
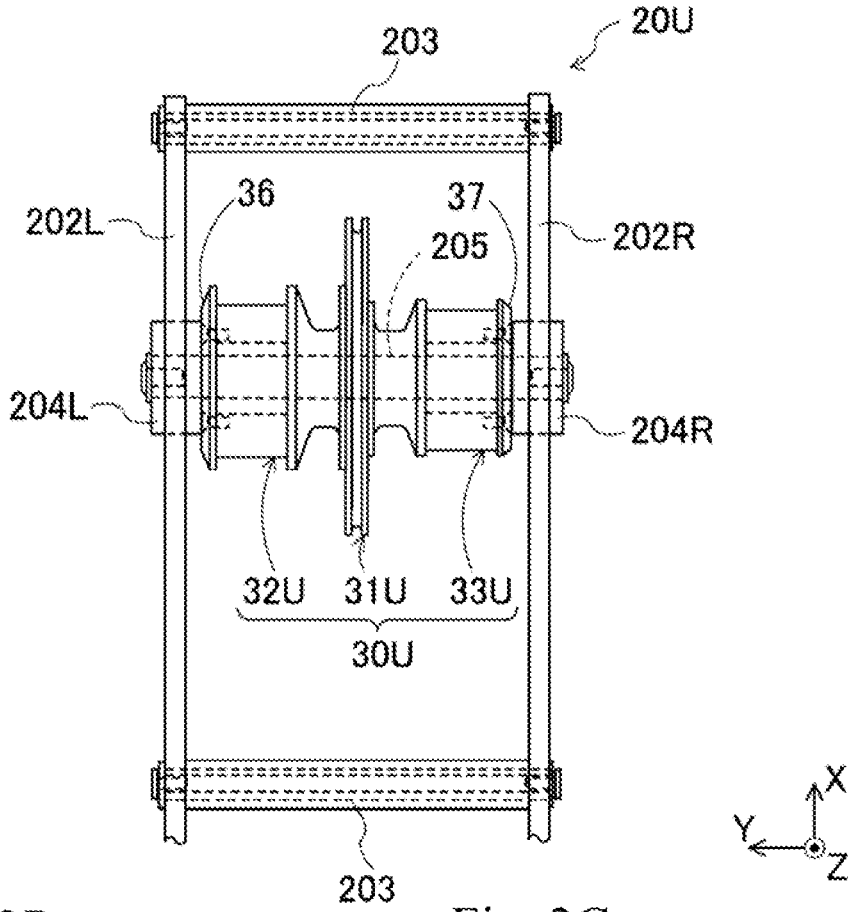
FIG. 2A is an enlarged front view of an upper end portion of a reel and a holder provided with a bow 1.
Figure 2B:
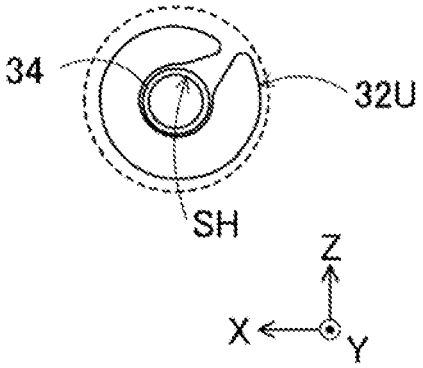
FIG. 2B is a left side view of a large diameter cam provided with the reel.
Figure 2C:
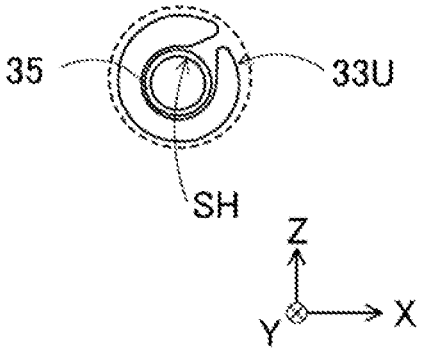
FIG. 2C is a right side view of a small diameter cam provided with the reel.

FIG. 1 is a side view of a bow 1 concerning an embodiment of the present invention. FIG. 2A is an enlarged front view of an upper end portion of a reel 30U and a holder 20U provided with the bow 1. FIG. 2B is a left side view of a large diameter cam 32U provided with the reel 30U. FIG. 2C is a right side view of a small diameter cam 33U provided with the reel 30U.

Note that the outer shape of the holders 20U, 20L is shown by bold lines in FIG. 1 for facilitating the understanding. Furthermore, cables 50, 60 are shown assuming that the cables 50, 60 are located at the left side surface of a bow body 10 and the holders 20U, 20L for clarifying the position. In addition, a string 40 and the cables 50, 60 are omitted in FIG. 2A for facilitating the understanding. In addition, FIG. 2B illustrates the large diameter cam 32U in a state that a rotary shaft 205 is detached from the reel 30U shown in FIG. 2A and a disk-shaped lid 36 provided on the left side surface of the large diameter cam 32U is detached. Similarly, FIG. 2C illustrates the small diameter cam 33U in a state that the rotary shaft 205 is detached from the reel 30U and a disk-shaped lid 37 provided on the right side surface of the small diameter cam 33U is detached.

As shown in FIG. 1, the bow 1 has a bow body 10, holders 20U, 20L provided on the upper end and lower end of the bow body 10 respectively, reels 30U, 30L which are supported by the holders 20U, 20L so that the string 40 and the cables 50, 60 are tensed between the reels 30U, 30L.

The bow body 10 is formed in a circular-arc plate shape. A large number of triangle-shaped notches 101 is formed on the above described plate surface. Consequently, the bow body 10 has a plane truss structure. As a result, the bow body 10 has high rigidity and the bow body 10 is hardly deformed even when the later described cables 50, 60 are elastically deformed.

In addition, the holders 20U, 20L for holding the reels 30U, 30L to which the string 40 and the cables 50, 60 are tensed are attached to the upper end and the lower end of the bow body 10.

The holders 20U, 20L are formed in a plate shape of a concave pentagon recessed in a shorter direction in a side view. The upper end or the lower end in a longitudinal direction of the holders 20U, 20L is connected with the bow body 10. Similar to the bow body 10, the holders 20U, 20L have a plane truss structure including a large number of triangular shapes. Thus, the holders 20U, 20L have high rigidity.

Although it will be described later, the bow body 10 is assembled by arranging two circular-arc plates in the lateral (left/right) direction and connecting them by a connecting rod. Each of the holders 20U, 20L has two concave pentagonal plates since the holders 20U, 20L are connected with the bow body 10 having the above described structure.

In detail, as shown in FIG. 2A, the holder 20U has plates 202R, 202L which are arranged in the lateral direction (i.e., Y-direction) and connected by a connecting rod 203. In addition, although it is not illustrated, the holder 20L also has the plates 202R, 202L connected by the connecting rod 203.

Note that the holder 20L has the same configuration as the holder 20U except for that they are formed symmetrically to each other in the vertical direction. Accordingly, the configuration of the holder 20U will be explained and the explanation of the holder 20L will be omitted in the specification of the present invention.

Not illustrated through hole is formed in the plates 202R, 202L and bearings 204R, 204L shown in FIG. 2A are fitted to the through hole. The bearings 204R, 204L rotatably hold the rotary shaft 205 which penetrates thorough the reel 30U in the lateral direction. Consequently, the plates 202R, 202L rotatably hold the reel 30U.

The reel 30U has a string cam 31U, a large diameter cam 32U and a small diameter cam 33U for winding the string 40 and the cables 50, 60 around the reel 30U respectively.

Here, the string 40 is a member for nocking the arrow on it. The string 40 is formed of threads which are hardly elastically deformed and hardly extended (i.e., threads having high elastic modulus) for correctly transferring the drawing weight to the reel 30U. On the other hand, the cables 50, 60 are members to be elastically deformed instead of the limbs which are provided on a normal bow. The cables 50, 60 are formed of the threads having the lower elastic modulus compared to the threads of the string 40.

Although it is not illustrated, the string cam 31U, the large diameter cam 32U and the small diameter cam 33U are formed in a non-circular plate shape. In detail, they are formed in a plate shape where curved surfaces having different curvatures are connected in the circumferential direction. A concave portion (i.e., groove) is formed on an outer periphery of the circular plate of them, and the string 40 and the cables 50, 60 are wound around the groove.

Note that the large diameter cam 32U and the small diameter cam 33U are also referred to as a cable cam in the specification of the present invention.

In addition, as shown in FIG. 2A, the outer diameters of the string cam 31U, the large diameter cam 32U and the small diameter cam 33U are increased in this order. The large diameter cam 32U, the string cam 31U and the small diameter cam 33U are arranged in this order from the left side (i.e., from +Y side). The string cam 31U, the large diameter cam 32U and the small diameter cam 33U are coaxially and integrally combined. Consequently, when the string 40 is drawn and the string cam 31U is rotated in a direction RU shown in FIG. 1, the large diameter cam 32U and the small diameter cam 33U are rotated in the same direction interlockingly with the string cam 31U. Although it is not illustrated, the direction RU is the opposite direction to the winding direction of the cable 50 wound to the large diameter cam 32U and the same direction as the winding direction of the cable 60 wound to the small diameter cam 33U. As a result of the rotation in the direction RU, the large diameter cam 32U winds the cable 50 and the small diameter cam 33U feeds the cable 60.

On the other hand, the reel 30L shown in FIG. 1 is formed in a vertically and horizontally reversed shape with the reel 30U. In detail, although it is not illustrated, the reel 30L has a string cam, a large diameter cam and a small diameter cam having the same shape as the string cam 31U, the large diameter cam 32U and the small diameter cam 33U respectively. The small diameter cam, the string cam and the large diameter cam are arranged in this order from the +Y side. Furthermore, both ends of the cable 50 are wound around the small diameter cam and the string 40 is wound around the string cam. In addition, both ends of the cable 60 are wound around the large diameter cam. Consequently, when the string 40 is drawn, the string cam, the small diameter cam and the large diameter cam are interlocked with each other and rotated in a direction RL shown in FIG. 1. Although it is not illustrated, the direction RL is the same direction as the winding direction of the cable 50 wound to the small diameter cam and the opposite direction of the winding direction of the cable 60 wound to the large diameter cam. As a result, the small diameter cam feeds the cable 50 and the large diameter cam winds the cable 60.

At this time, the amount of feeding the cable 50 from the small diameter cam of the reel 30L is less than the amount of winding the cable 50 by the above described large diameter cam 32U of the reel 30U. In addition, the amount of winding the cable 60 by the large diameter cam of the reel 30L is more than the amount of feeding the cable 60 from the small diameter cam 33U of the reel 30U. Consequently, the cables 50, 60 are pulled and elastically deformed. As a result, when the string 40 is drawn and released, the reels 30U, 30L are rotated in the opposite direction by the elastic force of the cables 50, 60 and the arrow nocked on the string 40 is shot.

As described above, the reels 30U, 30L elastically deform the cables 50, 60 by the force of drawing the string 40 and the force of drawing the string 40 is converted into the force of shooting the arrow.

In the reels 30U, 30L, although it is not illustrated, in order to tense the string 40 between the reels 30U, 30L, rings are provided on both ends of the string 40, pins inserted into each of the rings are fixed to the plate surface side of string cam 31U, and the string 40 is wound around the groove provided on the outer periphery of the string cam 31U.

In addition, in the reels 30U, 30L, in order to tense the cables 50, 60, rings are provided on both ends of the cables 50, 60 and bobbins 34, 35 shown in FIG. 2B and FIG. 2C inserted into the rings are housed in cylindrical inner spaces provided on the large diameter cam 32U and the small diameter cam 33U in a state that the rotary shaft 205 is inserted through a shaft hole SH. Furthermore, although it is not illustrated, the cables 50, 60 extending from the bobbins 34, 35 are drawn out from the openings communicating through the inner space of the large diameter cam 32U and the small diameter cam 33U, and the drawn cables 50, 60 are wound around the grooves provided on the outer periphery of the large diameter cam 32U and the small diameter cam 33U.

As described above, the string 40 and the cables 50, 60 are tensed between the reels 30U, 30L while the tensile force is applied. Therefore, the tensile force should be loosened when replacing the string 40 and the cables 50, 60. As a result, work requiring power is needed in many cases. Consequently, the replacement is not easy. In particular, since the cables 50, 60 are wound around a pulley 70 shown in FIG. 1 located at the center in the vertical direction of the bow body 10, the tensile force is strong and the replacement is not easy.

Therefore, in the bow 1, for facilitating the replacement of the string 40 and the cables 50, 60, the reels 30U, 30L are not directly attached to the bow body 10. The reels 30U, 30L are attached to the above described holders 20U, 20L. The holders 20U, 20L are foldable with respect to the bow body 10. Then, the folding mechanism of the holders 20U, 20L will be explained with reference to FIG. 3 to FIG. 5.

Figure 3:
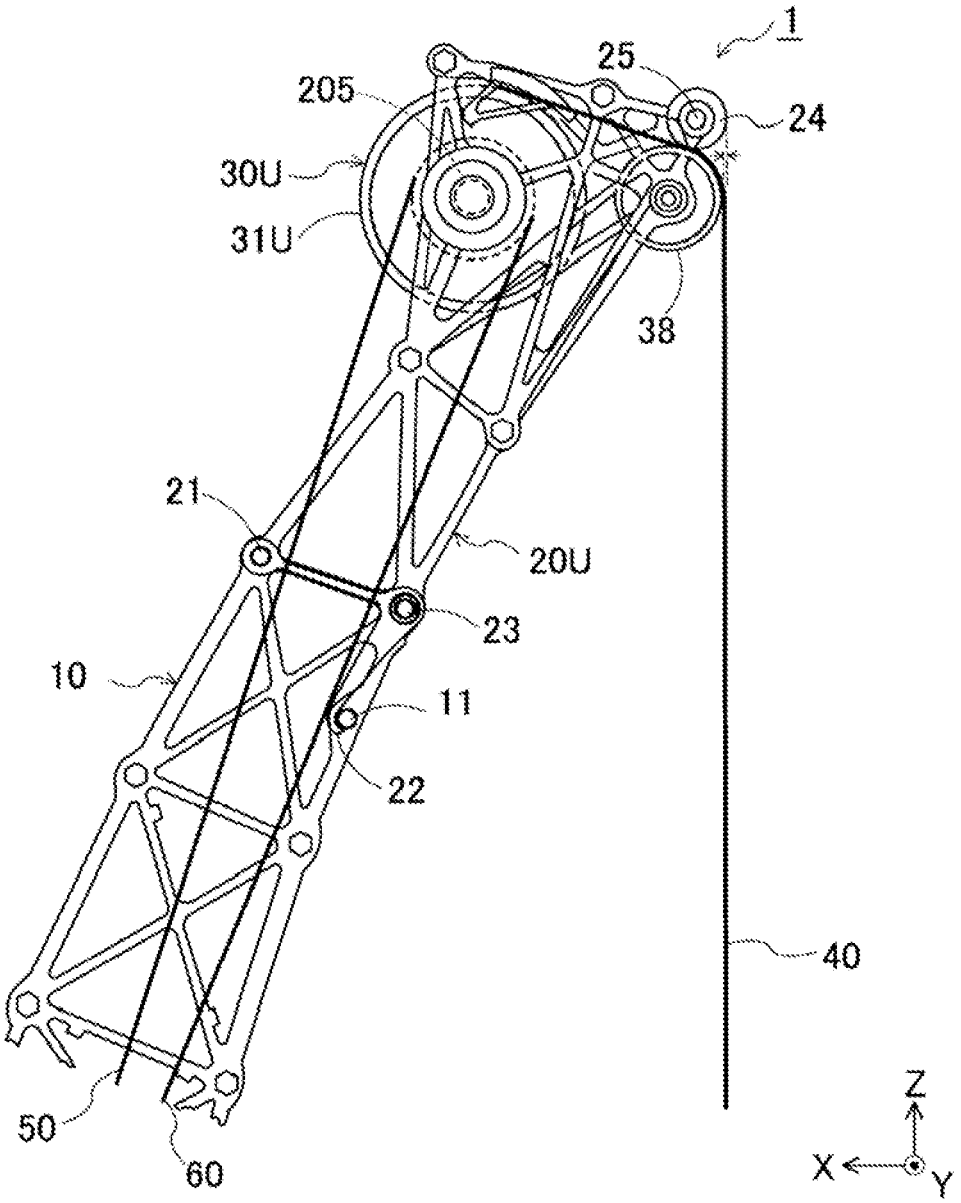
FIG. 3 is an enlarged side view of an upper end portion of the bow.
Figure 4:
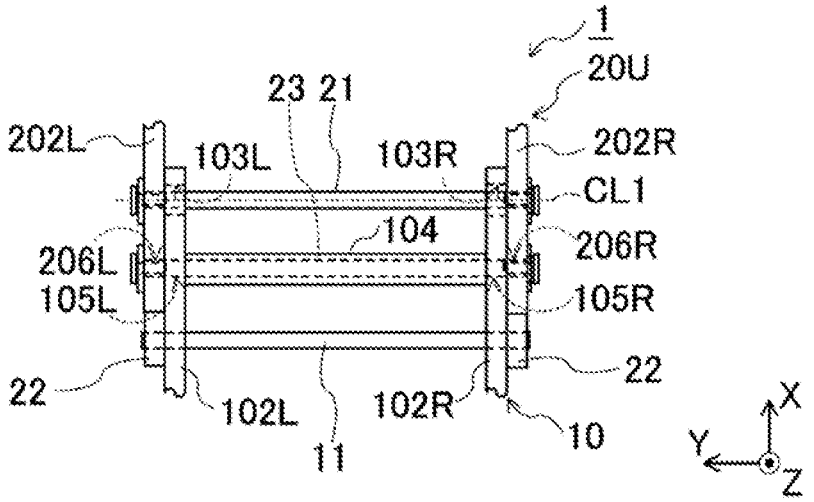
FIG. 4 is an enlarged front view of a connection pin, a fixing pin and a stopper provided with the bow.
Figure 5:
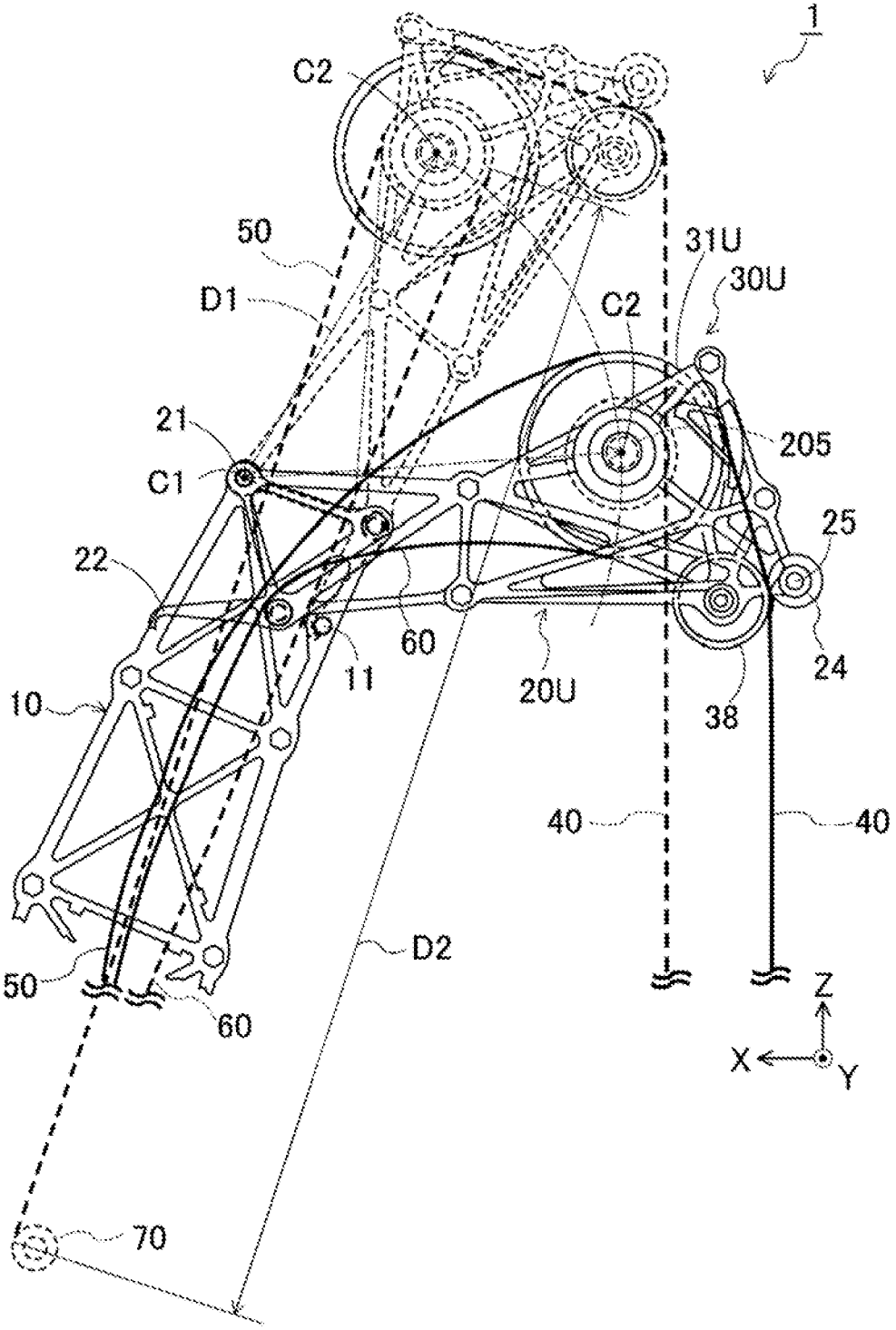
FIG. 5 is an enlarged side view of an upper end portion of the bow when the holder is folded.

FIG. 3 is an enlarged side view of an upper end portion of the bow 1. FIG. 4 is an enlarged front view of a connection pin 21, a fixing pin 23 and a stopper 11 provided with the bow 1. FIG. 5 is an enlarged side view of an upper end portion of the bow 1 when the holder 20U is folded.

Note that FIG. 3 and FIG. 4 show the bow 1 when the holder 20U is in an extended state (first state for tensioning the cable) in the folding mechanism of the holder 20U. FIG. 5 shows the bow 1 when the holder 20U is in a folded state (second state for loosening the cable). In addition, the positions of the connection pin 21, the hooks 22, the fixing pin 23 and the stopper 11 are displaced in the vertical direction compared to the actual positions for facilitating the understanding. In addition, the extended state of the holder 20U is shown in dot lines in FIG. 5. In FIG. 3 and FIG. 5, the cables 50, 60 are shown assuming that the cables 50, 60 are located at the left side surface of the bow body 10 and the holder 20U for clarifying the position.

As shown in FIG. 3, the folding mechanism of the holder 20U is arranged on the upper end of the bow body 10 and the folding mechanism includes a connection pin 21 for connecting the holder 20U with the bow body 10 so as to be pivotable (rotatable), a stopper 11 arranged on the upper end of the bow body 10 for restricting the pivot (rotation) of the holder 20U, hooks 22 looked to the stopper 11 when the holder 20U is pivoted to a predetermined position, a fixing pin 23 for fixing the holder 20U to the bow body 10 in a state that the hooks 22 are looked to the stopper 11, and a roller 24 for protecting the reel 30U from the pivot of the bow body 10.

Note that the folding mechanism provided with the holder 20L has the same configuration as the folding mechanism provided with the holder 20U except for that they are formed symmetrically to each other in the vertical direction. Accordingly, the configuration of the folding mechanism provided with the holder 20U will be explained and the explanation of the folding mechanism provided with the holder 20L will be omitted in the specification of the present invention.

As shown in FIG. 3 and FIG. 4, the connection pin 21 is formed in a linearly extending columnar shape. On the other hand, as described above, the holder 20U is assembled by arranging the plates 202R, 202L shown in FIG. 2A in the lateral (left/right) direction and connecting them by the connecting rod 203. As shown in FIG. 4, the connection pin 21 is arranged between the plates 202R, 202L and extends in the lateral direction. Namely, the connection pin 21 extends in a direction perpendicular to the direction connecting the both ends of the bow body 10 and perpendicular to the direction of shooting the arrow. The connection pin 21 connects the plates 202R, 202L by fixing both ends of the connection pin 21 to the plates 202R, 202L.

In addition, the bow body 10 is formed by combining two plates 102R, 102L. The plates 102R, 102L are fitted between the plates 202R, 202L in a state that the plate surface is directed in the lateral direction. Furthermore, the plates 102R, 102L have through holes 1038, 103L penetrating through the plate surface in the lateral direction. The connection pin 21 is inserted through the through holes 103R, 103L. Consequently, the connection pin 21 connects the plates 102R, 102L with the plates 202R, 202L. Namely, the connection pin 21 connects the bow body 10 with the holder 20U.

The inner diameter of the above described through holes 103R, 103L is larger than the outer diameter of the connection pin 21. Accordingly, the connection pin 21 can be rotated in the through holes 103R, 103L. Consequently, the holder 20U can be pivoted (rotated) around a center line CL1 of the through holes 103R, 103L. As a result, as shown in FIG. 3 and FIG. 5, the holder 20U is pivotable with respect to the upper end of the bow body 10. In detail, a posture of the holder 20U can be switched between the extended state shown in FIG. 3 where the longitudinal direction of the holder 20U is directed to (aligned with) the extension line of the bow body 10 and the folded state shown in FIG. 5 where the longitudinal direction of the holder 20U is directed to the rear side compared to the extension line of the bow body 10. Consequently, the arrow can be shot when the holder 20U is in the extended state, and the string 40 and the cables 50, 60 are loosened and the string 40 and the cables 50, 60 can be replaced when the holder 20U is in the folded state.

On the other hand, when the holder 20U is switched to the extended state, the bow 1 is used by drawing and releasing the string 40. At this time, if the holder 20U is pivoted, it is difficult to shoot the arrow in a correct direction. Therefore, the stopper 11 is provided on the bow body 10 for determining the extended position of the holder 20U.

As shown in FIG. 3 and FIG. 4, the stopper 11 has a linearly extending columnar shape. As shown in FIG. 4, the stopper 11 is arranged so that the columnar shaft is directed in the lateral direction. Furthermore, the stopper 11 penetrates through the plates 102R, 102L of the bow body 10 in the lateral direction. The right end of the stopper 11 is protruded to the right side of the plate 102R. In addition, the left side of the stopper 11 is protruded to the left side of the plate 102L. Consequently, the stopper 11 is in contact with the plates 202R, 202L of the holder 20U located at the right side of the plate 102R and left side of the plate 102L. Thus, the stopper 11 can restrict the movement of the plates 202R, 202L.

As shown in FIG. 3, the stopper 11 is provided on the rear part of the upper end of the bow body 10. This is because the above described connection pin 21 connects the holder 20U at the front part of the upper end of the bow body 10 and the rear part of the lower end of the holder 20U is moved while overlapping with the rear part of the upper end of the bow body 10 when the holder 20U is pivoted around the connection pin 21. Thus, the above described movement of the holder 20U can be efficiently restricted. On the other hand, as shown in FIG. 4, the hooks 22 are provided on the plates 202R, 202L of the holder 20U so that the hooks 22 are hooked on the right end and left end of the stopper 11 for locking the plates 202R, 202L.

Since the connection pin 21 connects the front part of the lower end of the holder 20U with the bow body 10, the hooks 22 are formed on the rear part of the lower end of the holder 20U as shown in FIG. 3 and FIG. 5. The hooks 22 linearly extend from the lower end of the holder 20U along the rear end surface of the holder 20U and the end portion of the hooks 22 is bent in an arc shape. The bent portion located at the end portion of the hooks 22 is locked to the stopper 11 when the holder 20U is pivoted to the extended state shown in FIG. 3. Consequently, the hooks 22 determine the extended position of the holder 20U. As a result, the hooks 22 prevent the holder 20U from pivoting to the front side exceeding the extended position. The fixing pin 23 is provided on the bow 1 for fixing the holder 20U is to the bow body 10 while the hooks 22 are locked to the stopper 11.

As shown in FIG. 4, a cylinder 104 is provided between the plates 102R, 102L of the bow body 10 for connecting the plates 102R, 102L with each other. In addition, through holes 105R, 105L communicating through the inner space of the cylinder 104 are formed on the plates 102R, 102L. Furthermore, through holes 206R, 206L are formed on the plates 202R, 202L of the holder 20U so that the positions of the through holes 206R, 206L are overlapped with the through holes 105R, 105L in the lateral direction when the holder 20U is in the extended state. The fixing pin 23 is detached from the bow 1 when the holder 20U is in the folded state, while the fixing pin 23 is inserted through the through holes 105R, 105L, 206R and 206L and inserted into the inner space of the cylinder 104 when the holder 20U is in the extended state. Both ends of the fixing pin 23 are fixed by screws for preventing the fixing pin 23 from being removed. Consequently, the fixing pin 23 fixes the plates 202R, 202L to the plates 1028, 102L. Namely, the fixing pin 23 fixes the holder 20U to the bow body 10.

On the other hand, when the holder 20U is switched from the folded state to the extended state, it is necessary to pivot the holder 20U by a relatively strong force since the string 40 and the cables 50, 60 are switched from the loosened state to the tensed state. As shown in FIG. 3, the roller 24 is provided on the rear part of the upper end of the holder 20U for facilitating the switching from the folded state to the extended state so that the rear part of the upper end of the holder 20U can be easily pushed.

The roller 24 is provided as a portion to be pushed or grasped to apply the force to the holder 20U when the holder 20U is switched from the folded state to the extended state. On the other hand, a pulley 38 is provided on the rear part of the upper end of the holder 20U for adjusting the position of winding the string 40 around the string cam 31U. The pulley 38 is arranged on the rear side of the string cam 31U and the string 40 wound around the pulley 38 is wound around the string cam 31U. The roller 24 is provided on the position farthest from a pivot center C1 of the connection pin 21 shown in FIG. 5 in the holder 20U for protecting the pulley 38. Consequently, the roller 24 is arranged above the pulley 38 in the extended state. In addition, the roller 24 is protruded rearward compared to the pulley 38. Consequently, the roller 24 is protruded rearward compared to the string 40 tensed in the vertical direction. As a result, the pulley 38 and the reel 30U are prevented from contacting the peripheral object and being damaged when the roller 24 is pressed to switch the holder 20U from the folded state to the extended state.

In addition, the roller 24 is formed in a cylindrical shape having a hole opened in the center. On the other hand, a pin 25 directed in the lateral direction (i.e., Y-direction) is provided on the rear part of the upper end of the holder 20U. The pin 25 is inserted into the hole provided on the center of the roller 24 and thus the roller 24 can be rotated around the pin 25. In the bow 1, the holder 20U can be switched from the folded state to the extended state by pressing the roller 24 to the flat surface such as a desk, a floor and the like. At this time, the roller 24 is rotated for facilitating the switching operation of the holder 20U.

Then, the folding method of the holders 20U, 20L when replacing the string 40 and the cables 50, 60 will be explained. Note that the holder 20L has the same configuration as the holder 20U except for that they are formed symmetrically to each other in the vertical direction. Thus, the configuration of the holder 20U will be explained and the explanation of the holder 20L will be omitted.

As shown in FIG. 3, the holder 20U is in the extended state when using the bow 1. In this state, the hooks 22 of the holder 20U are locked to the stopper 11 of the bow body 10. In addition, the fixing pin 23 fixes the holder 20U to the bow body 10. As a result, the holder 20U is firmly fixed to the bow body 10 in the extended position.

For replacing the string 40 and the cables 50, 60 from the above described state, first of all, the fixing pin 23 shown in FIG. 4 is pulled out from the through holes 206R, 206L of the holder 20U and the through holes 105R, 105L of the bow body 10.

In detail, although it is not illustrated, the through holes 206R, 206L of the holder 20U have a hole shape where the longitudinal direction is directed in an approximately in the vertical direction (i.e., Z-direction) and the width becomes wider toward −Z direction. Accordingly, when the roller 24 of the holder 20U shown in FIG. 3 and a not illustrated roller of the holder 20L are pressed to the flat surface and the holders 20U, 20L are slightly pushed toward +X direction, the through holes 206R, 206L are moved in +Z direction with respect to the fixing pin 23. Consequently, the fixing pin 23 is relatively moved to the wider portion located in −Z direction of the through holes 206R, 206L. As a result, the fixing pin 23 can be easily pulled. Therefore, the fixing pin 23 is pulled from the through holes 206R, 206L shown in FIG. 4 and the through holes 105R, 105L of the bow body 10 in this state.

In addition, although it is not illustrated, the fixing pin 23 is pulled from the through holes 206R, 206L and the through holes 1058, 105L also in the holder 20L by the same operation. Consequently, the fixing of the holders 20U, 20L to the bow body 10 is released. As a result, the holders 20U, 20L can be pivoted with respect to the bow body 10.

Then, the holder 20U is pushed backward and the holder 20U is switched (shifted) to the folded state as shown in FIG. 5. Although it is not illustrated, the holder 20L is also switched to the folded state in the same way.

At this time, if the holder 20U is moved backward while a distance D2 from the pulley 70 to the reel 30U shown in FIG. 5 is maintained, the tensile force of the cables 50, 60 is kept.

However, the reel 30U is moved along an arc having a distance D1 from the pivot center C1 of the connection pin 21 of the bow body 10 to a pivot center C2 of the rotary shaft 205 of the reel 30U as a radius. The center C1 is located in the middle between the pulley 70 and the reel 30U of the holder 20U before folded. The distance D1 is shorter than the distance D2 which is the distance from the pulley 70 to the reel 30U. As a result, when the holder 20U is moved rearward and switched to the folded state, the distance from the pulley 70 to the reel 30U becomes shorter than the distance D2. Consequently, the cables 50, 60 are loosened. Similarly, when the holder 20U is switched to the folded state, the string 40 is also loosened.

For the same reason, when the holder 20L is switched to the folded state, the string 40 and the cables 50, 60 are loosened.

In the above described folded state, the rotary shaft 205 shown in FIG. 2A is detached from the reel 30U, the disk-shaped lids 36, 37 are detached from the large diameter cam 32U and the small diameter cam 33U, the bobbins 34, 35 shown in FIG. 2B and FIG. 2C are took out, and the cables 50, 60 are detached from the large diameter cam 32U and the small diameter cam 33U. In addition, a not illustrated string fixing pin of the string cam 31U is detached and the string 40 is detached from the string cam 31U. The same operation is performed also for the reel 30L shown in FIG. 1. As described above, the string 40 and the cables 50, 60 are replaced.

After the string 40 and the cables 50, 60 are replaced, the holders 20U, 20L are returned from the folded state to the extended state. At this time, it is preferable to push the holders 20U, 20L to the frontward of the bow 1 by pressing the roller 24 of the holder 20U shown in FIG. 3 and a not illustrated roller of the holder 20L to the flat surface, for example. The roller 24 is pressed until the hooks 22 are locked to the stopper 11.

Then, after the hooks 22 are locked to the stopper 11, the fixing pin 23 is inserted into the through holes 206R, 206L of the holder 20U and the through holes 105R, 105L of the bow body 10 shown in FIG. 4. Consequently, the holder 20U is fixed to the bow body 10 by using the fixing pin 23. Similarly, the holder 20L is fixed to the bow body 10. As described above, the replacement of the string 40 and the cables 50, 60 is finished.

Note that the hooks 22 and the fixing pin 23 are the mechanism for stopping the pivot of the holders 20U, 20L and fixing the holders 20U, 20L to the bow body 10. Accordingly, the hooks 22 and the fixing pin 23 are also referred to as a locking mechanism in the specification of the present invention.

In addition, the front part of the lower end of the holder 20U is connected with the bow body 10 by the connection pin 21 in the present embodiment. In addition, although it is not illustrated, the front part of the upper end of the holder 20L is connected with the bow body 10 by the connection pin 21. The above described portions of the holders 20U, 20L to be connected with the bow body 10 are referred to as a base portion in the specification of the present invention. Namely, the base portion is pivotably held on each of the both ends of the bow body 10. The portions distanced from the base portion and provided with the reels 30U, 30L are referred to as an end portion in the specification of the present invention. The end portion rotatably holds each of the cable cams.

As described above, in the bow 1 of the embodiment, the holders 20U, 20L are pivoted with respect to the upper end and the lower end of the bow body 10 respectively. Namely, the base portion is pivotable around the connection pin 21. Consequently, a posture of the holders 20U, 20L can be switched between the extended state where the upper end and the lower end (i.e., end portions) are directed to the extension line of the bow body 10 and the folded state where the end portions are directed to the center side of the bow body 10. Namely, the posture of the holders 20U, 20L can be switched between the extended state where the end portions are arranged on the extension line extending from each of the both ends of the bow body 10 and the folded state where the end portions are arranged nearer to a center of the bow body compared to the extension line. Accordingly, the posture of the holders 20U, 20L can be switched to the folded state to loosen the string 40 and the cables 50, 60. Thus, the string 40 and the cables 50, 60 can be replaced. As a result, in the bow 1, the string 40 and the cables 50, 60 can be replaced easily.

The bow 1 has high rigidity in spite of having a foldable structure since the hooks 22 locked to the stopper 11 are provided for restricting the pivot of the holders 20U, 20L when the holders 20U, 20L are in the extended state. As a result, the decrease in the shooting rate of the arrow 1 caused by the distortion of the bow 1 is prevented.

In addition, since the bow 1 has the fixing pin 23 for fixing the holders 20U, 20L to the bow body 10 when the holders 20U, 20L are in the extended state, the rigidity is further increased and the shooting rate of the arrow is hardly decreased.

The holders 20U, 20L have the roller 24 arranged at a part most separated from the pivot center C1 of the connection pin 21 and protruded rear side compared to the string 40 tensed in the vertical direction. Accordingly, even when the holders 20U, 20L are pivoted around the connection pin 21 for switching the posture, the reels 30U, 30L and the pulley 38 are hardly damaged.

In addition, the holders 20U, 20L can be pivoted for changing the posture by grasping or pushing the roller 24. As a result, the posture of the holders 20U, 20L can be easily changed.

Although the embodiments of the present invention are explained above, the present invention is not limited to the above described embodiments. In the above described embodiments, the holders 20U, 20L are pivoted around the connection pin 21 and the connection pin 21 has a columnar shape. However, the present invention is not limited to the above described configuration. In the present invention, it is preferred that the holders 20U, 20L can be pivoted around the shaft member and the connection pin 21 explained in the embodiments is the shaft member. For example, the connection pin 21 can be a cylindrical shaft.

In the above described embodiments, the holders 20U, 20L have the hooks 22. However, the present invention is not limited to the above described configuration. In the present invention, it is preferred that the bow 1 has a locking mechanism for stopping the pivot of the holders 20U, 20L and fixing the holders 20U, 20L to the bow body 10.

In that case, the locking mechanism preferably has a contact member which is provided on either one of each of the holders 20U, 20L and each of the both ends of the bow body 10 so that the contact member is in contact with the stopper 11 formed on the other of each of the holders 20U, 20L and each of the both ends of the bow body 10 for stopping the pivot of the holders 20U, 20L when the holders 20U, 20L are switched to the state of tensing the cables 50, 60 (i.e., extended state). Furthermore, the locking mechanism preferably has a fixing member for fixing each of the holders 20U, 20L to each of the both ends of the bow body 10 in a state that the contact member stops the pivot of each of the holders 20U, 20L.

For example, the holders 20U, 20L can have the protrusions instead of the hooks 22. In that case, it is also possible that the protrusions are in contact with the stopper 11 for stopping the pivot of the holders 20U, 20L.

In addition, it is also possible that the hooks 22 are provided on the bow body 10 and the stopper 11 is provided on the holders 20U, 20L.

In the above described embodiments, the member for fixing the holders 20U, 20L to the bow body 10 is the fixing pin 23. However, the present invention is not limited to the above described configuration. In the present invention, it is enough if the holders 20U, 20L are fixed to the bow body 10 by the fixing member. For example, the fixing pin 23 can be a stopper such as a bolt, a screw and the like.

In the above described embodiments, the roller 24 is provided on the holders 20U, 20L. However, the present invention is not limited to the above described configuration. It is enough if the roller 24 is the protruding member arranged at a part most separated from the pivot center C1 in the holders 20U, 20L and protruded rear side compared to the string 40. For example, the roller 24 can be a not-rotated protruding member having a columnar shape or a hemispherical shape.

In the above described embodiments, the explanation is made in condition that the arrow is shot while directing the string 40 in the vertical direction. However, the present invention is not limited to the above described configuration. In the present invention, the direction of the string 40 when shooting the arrow can be arbitrarily determined. The arrow can be shot from the bow 1 while the string 40 is inclined. Since the direction of the string 40 can be arbitrarily determined, the upper end and the lower end of the bow body 10 can be also referred to as one end and the other end.

DESCRIPTION OF THE REFERENCE NUMERALS

1: bow
10: bow body
11: stopper
20U, 20L: holder
21: connection pin
22: hook
23: fixing pin
24: roller
25: pin
30U, 30L: reel
31U: string cam
32U: large diameter cam
33U: small diameter cam
34, 35: bobbin
36, 37: disk-shaped lid
38: pulley
40: string
50, 60: cable
70: pulley
101: notch
102R, 102L: plate
103R, 103L: through hole
104: cylinder
105R, 105L: through hole
201: notch
202R, 202L: plate
203: connecting rod
204R, 204L: bearing
205: rotary shaft
206R, 206L: through hole
CL1: center line
C1, C2: pivot center
D1, D2: distance
RL, RU: direction
SH: shaft hole

What is claimed is:

1. A bow, comprising:

a bow body;

a plurality of string cams around which each of both ends of a string for nocking an arrow is wound, the string cams being rotated when the string is drawn;

a plurality of cable cams around which each of both ends of an elastically deformable cable is wound, each of the cable cams being rotated interlockingly with each of the string cams to elastically deform the cable; and a plurality of holders, each of the holders having a base portion pivotably held on each of both ends of the bow body and an end portion for rotatably holding each of the cable cams, wherein each of the holders is configured to pivot with respect to each of the both ends of the bow body to switch a posture of the holders between a first state for tensioning the cable where the end portion is arranged on an extension line extending from each of the both ends of the bow body and a second state for loosening the cable where the end portion is arranged nearer to a center of the bow body compared to the extension line.

2. The bow according to claim 1, further comprising:

a shaft member arranged on each of the both ends of the bow body, the shaft member extending in a direction perpendicular to the direction connecting the both ends of the bow body and perpendicular to the direction of shooting the arrow, wherein the base portion provided on each of the holders is pivotable around the shaft member.

3. The bow according to claim 1, further comprising:

a locking mechanism for stopping a pivot of each of the holders and fixing each of the holders to each of the both ends of the bow body when each of the holders is pivoted with respect to each of the both ends of the bow body to switch the posture of the holders to the first state for tensioning the cable.

4. The bow according to claim 3, wherein:

the locking mechanism includes:

a contact member provided on either one of each of the holders and each of the both ends of the bow body to stop the pivot of each of the holders by contacting with a stopper formed on the other of each of the holders and the both ends of the bow body when each of the holders is pivoted with respect to each of the both ends of the bow body to switch the posture of the holders to the first state for tensioning the cable; and a fixing member for fixing each of the holders to each of the both ends of the bow body in a state that the contact member stops the pivot of each of the holders.

5. The bow according to claim 1, wherein:

each of the holders has a protruding member which is arranged at a part most separated from a pivot center of each of the holders in the end portion, the protruding member being protruded rearward compared to the string tensed between the string cams when the posture of the holders is in the first state for tensioning the cable.

* * * * *